US011766843B2

(12) United States Patent
Tasaka et al.

(10) Patent No.: US 11,766,843 B2
(45) Date of Patent: Sep. 26, 2023

(54) PRINTING UNIT, PRINTING DEVICE, BOX MAKING MACHINE

(71) Applicant: MITSUBISHI HEAVY INDUSTRIES MACHINERY SYSTEMS, LTD., Hyogo (JP)

(72) Inventors: Norifumi Tasaka, Hyogo (JP); Makoto Kaji, Hyogo (JP); Shuichi Takemoto, Hyogo (JP); Toshiaki Miyakura, Hyogo (JP); Eikichi Tanaka, Hyogo (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 80 days.

(21) Appl. No.: 17/261,310

(22) PCT Filed: Jun. 11, 2019

(86) PCT No.: PCT/JP2019/023045

§ 371 (c)(1),
(2) Date: Jan. 19, 2021

(87) PCT Pub. No.: WO2020/021885

PCT Pub. Date: Jan. 30, 2020

(65) Prior Publication Data

US 2021/0347140 A1 Nov. 11, 2021

(30) Foreign Application Priority Data

Jul. 27, 2018 (JP) ..... 2018-141788

(51) Int. Cl.
*B31B 50/88* (2017.01)
*B31B 50/20* (2017.01)
(Continued)

(52) U.S. Cl.
CPC ..... *B31B 50/88* (2017.08); *B31B 50/04* (2017.08); *B31B 50/20* (2017.08); *B31B 50/26* (2017.08);
(Continued)

(58) Field of Classification Search
CPC ..... B31B 50/042; B31B 50/26; B31B 50/04; B31B 50/88; B31B 50/20; B31B 50/07;
(Continued)

(56) References Cited

U.S. PATENT DOCUMENTS

2010/0210436 A1* 8/2010 Taketsugu ..... B65H 29/62 493/29
2011/0013204 A1* 1/2011 Nakagaki ..... B41J 25/312 358/1.8
2015/0290926 A1* 10/2015 Branca ..... B41F 5/24 101/212

FOREIGN PATENT DOCUMENTS

JP H08311782 A * 11/1996 ..... B41J 3/4078
JP 2016179610 A 10/2016

* cited by examiner

*Primary Examiner* — Thomas M Wittenschlaeger
(74) *Attorney, Agent, or Firm* — HAUPTMAN HAM, LLP

(57) ABSTRACT

A printing unit includes a support frame that is supported to face a transfer passage for a sheet; an inkjet head that is fixed to the support frame and performs printing on a printing surface of the sheet; drive bodies that are rotatably supported on the support frame on both sides of the inkjet head in a width direction of the sheet and come into contact with the printing surface of the sheet; and a drive device that drives and rotates the drive bodies.

18 Claims, 7 Drawing Sheets

(51) Int. Cl.

| | |
|---|---|
| ***B31B 50/04*** | (2017.01) |
| ***B31B 50/26*** | (2017.01) |
| ***B41F 5/24*** | (2006.01) |
| ***B41J 13/03*** | (2006.01) |
| *B31B 50/00* | (2017.01) |
| *B65H 5/00* | (2006.01) |

(52) U.S. Cl.
CPC ..... *B41F 5/24* (2013.01); *B41J 13/03* (2013.01); *B31B 50/005* (2017.08); *B65H 5/002* (2013.01)

(58) Field of Classification Search
CPC ..... B31B 50/58; B31B 50/005; B31B 50/98; B31B 50/36; B41J 25/3082; B41J 13/03; B41J 13/0027; B41J 13/08; B41J 2/01; B41J 15/048; B41F 19/004; B41F 19/008; B41F 19/007; B41F 5/24; B65H 5/002
See application file for complete search history.

PRINTING UNIT, PRINTING DEVICE, BOX MAKING MACHINE

RELATED APPLICATIONS

The present application is a National Phase of International Application Number PCT/JP2019/023045 filed Jun. 11, 2019 and claims priority to Japanese Application Number 2018-141788 filed Jul. 27, 2018.

TECHNICAL FIELD

The present invention relates to a printing unit that performs printing on a sheet such as a cardboard sheet, a printing device having the printing unit, and a box making machine to which the printing device is applied.

BACKGROUND ART

For example, a general box making machine is for manufacturing a cardboard box having a flat shape by processing a cardboard sheet and is composed of a sheet feeding unit, a printing section, a slotter creaser unit, a die cutting unit, a folding unit, a counter ejector unit, and the like. In this box making machine, the printing section is for performing printing of one color or a multicolor and has one or a plurality of printing units. This printing unit is a flexographic printing machine, in which ink in an ink chamber is supplied to a printing die of a printing cylinder by an ink supply roll and the ink on the printing die of the printing cylinder is transferred to a cardboard sheet, whereby printing is performed.

Incidentally, as a printing device, it is considered to provide an inkjet type printing device in addition to a flexographic printing machine. In this case, the flexographic printing machine prints characters, patterns, or the like on a cardboard sheet, and the inkjet type printing device prints, for example, a bar code or the like on the cardboard sheet. In this inkjet type printing device, in order to maintain print quality and protect an inkjet head, it is necessary to maintain the distance between the inkjet head and the printing surface of the cardboard sheet at a predetermined distance. However, if the cardboard sheet is warped, the distance between the inkjet head and the printing surface of the cardboard sheet varies, and thus there is a concern that the cardboard sheet may come into contact with the inkjet head to damage the inkjet head.

As means for solving such a problem, for example, there is a technique described in PTL 1 below. In the inkjet printing device disclosed in PTL 1, a carriage of a printing section is supported by a support mechanism such that a swing operation in a width direction, a swing operation in a transfer direction, and a vertical movement in a vertical direction are possible, in a state where a position in the transfer direction is restricted, and the carriage is equipped with a point contact roller that forms a predetermined head gap between the inkjet head and a printing medium.

CITATION LIST

Patent Literature

[PTL 1] Japanese Unexamined Patent Application Publication No. 2016-179610

SUMMARY OF INVENTION

Technical Problem

In the printing device of the related art described above, the carriage is equipped with the inkjet head and is made such that the swing operations in the width direction and the transfer direction and the vertical movement in the vertical direction become possible by the support mechanism. Therefore, the inkjet head performs printing on the printing medium while swinging in the width direction or the transfer direction or moving up and down. In this case, when a transfer speed of the printing medium is a very slow speed, the point contact roller provided at the carriage or an upstream roller does not greatly affect the transfer of the printing medium. However, when the transfer speed of the printing medium is a high speed, in a case where the non-driving point contact roller or the upstream roller comes into contact with the printing surface of the printing medium, there is a concern that the printing medium may be braked or the printing medium may be delayed in the transfer direction or be twisted. Then, the printing accuracy of the inkjet head with respect to the printing surface of the printing medium is reduced.

The present invention is for solving the problems described above, and has an object to provide a printing unit, a printing device, and a box making machine, in which an inkjet head is stably supported regardless of the shape of a sheet, and thus the distance between the sheet and the inkjet head is kept constant and the sheet is appropriately transferred, whereby a decrease in printing accuracy is suppressed.

Solution to Problem

In order to achieve the above object, according to an aspect of the present invention, there is provided a printing unit including: a support frame that is supported to face a transfer passage for a sheet; an inkjet head that is fixed to the support frame and performs printing on a printing surface of the sheet; drive bodies that are rotatably supported on the support frame on both sides of the inkjet head in a width direction of the sheet and can come into contact with the printing surface of the sheet; and a drive device that drives and rotates the drive bodies.

Accordingly, when the sheet is transferred, printing is performed on the printing surface of the sheet by the inkjet head. At this time, the drive bodies disposed on both sides of the inkjet head can come into contact with the printing surface of the sheet on the transfer passage in a state of being driven by the drive device. Then, even if the sheet is warped in a sheet thickness direction, the sheet is applied with a transfer force while being pressed against a sheet transfer surface by the drive bodies that are driven. Therefore, since the sheet is stably supported and transferred by the drive bodies, printing by the inkjet head is performed in a state where the distance between the printing surface of the sheet and the inkjet head is kept constant. As a result, the inkjet head is stably supported regardless of the shape of the sheet, and thus the distance between the sheet and the inkjet head is kept constant and the sheet is appropriately transferred, whereby it is possible to suppress a decrease in printing accuracy.

In the printing unit according to the above aspect of the present invention, a predetermined fixed gap which is set in advance according to a thickness of the sheet is secured between a sheet transfer surface configuring the transfer passage for the sheet and the drive body.

Accordingly, when the sheet is transferred on the sheet transfer surface, the sheet on the sheet transfer surface enters the fixed gap secured between the sheet transfer surface and the drive body, whereby the drive body can press the printing surface of the sheet and stably transfer the sheet, and high-accuracy printing by the inkjet head can be performed while the distance between the sheet and the inkjet head is kept constant.

In the printing unit according to the above aspect of the present invention, the drive bodies include drive rollers which are disposed on both sides of the support frame in the width direction of the sheet and driven and rotated by the drive device, driven rollers which are disposed in front and rear of the drive roller in a transfer direction of the sheet on both sides of the support frame in the width direction of the sheet, and drive belts which are wound around the drive rollers and the driven rollers on both sides of the support frame in the width direction of the sheet.

Accordingly, when the sheet is transferred on the sheet transfer surface, the printing surface of the sheet on the sheet transfer surface is pressed continuously in the transfer direction of the sheet by the drive belts that are wound around the drive rollers and the driven rollers, and thus the sheet can be stably transferred by the drive bodies.

In the printing unit according to the above aspect of the present invention, the drive bodies include drive rollers which are disposed on both sides of the support frame in the width direction of the sheet and driven and rotated by the drive device.

Accordingly, when the sheet is transferred on the sheet transfer surface, the printing surface of the sheet on the sheet transfer surface is pressed by the drive rollers, and thus the sheet can be stably transferred by the drive bodies and a structure can be simplified.

In the printing unit according to the above aspect of the present invention, the printing unit further includes a first movement adjusting device which adjusts a position of the inkjet head by moving the support frame along the width direction of the sheet.

Accordingly, the inkjet head is moved along the width direction of the sheet through the support frame by the first movement adjusting devices to adjust the position of the inkjet head, and therefore, the printing position of the inkjet head in the width direction of the sheet can be easily adjusted with high accuracy.

In the printing unit according to the above aspect of the present invention, the printing unit further includes a second movement adjusting device which adjusts positions of the drive bodies by moving the support frame in a direction orthogonal to the printing surface of the sheet.

Accordingly, a moving body is moved along the direction orthogonal to the printing surface through the support frame by the second movement adjusting device to adjust the position of the moving body, and therefore, the position of the moving body can be easily adjusted with high accuracy according to the thickness of the sheet.

Further, according to another aspect of the present invention, there is provided a printing device in which a plurality of the printing units are disposed at predetermined intervals in a transfer direction of the sheet.

Accordingly, even if the printing positions of the plurality of printing units with respect to the printing surface of the sheet are positions close to each other in the width direction of the sheet, since the plurality of printing units are disposed in the transfer direction of the sheet, the printing timings for the respective printing units are deviated from each other, and thus the printing units can perform printing with high accuracy at predetermined positions.

According to another aspect of the present invention, there is provided a printing device including: the printing unit; and a flexographic printing unit that is disposed downstream of the printing unit in a transfer direction of the sheet.

Accordingly, since the flexographic printing unit performs printing on the printing surface of the sheet after the printing unit performs printing on the printing surface of the sheet, it is possible to secure the drying time of the ink on the surface printed by the printing unit with respect to the printing surface of the sheet and improve the print quality.

According to another aspect of the present invention, there is provided a printing device in which a plurality of the printing units are disposed in a width direction of the sheet and the drive device synchronously drives and rotates the drive bodies in the plurality of printing units.

Accordingly, the drive device synchronously drives and rotates the respective drive bodies of the plurality of printing units disposed in the width direction of the sheet, and therefore, the respective drive bodies can accurately and stably transfer the sheet along the transfer passage.

Further, according to another aspect of the present invention, there is provided a box making machine including: a sheet feeding unit that supplies a sheet material for box making; a printing section that performs printing on the sheet material for box making; a slotter creaser unit that performs creasing line processing and grooving processing on a front surface of the sheet material for box making; a folding unit that forms a box body by folding the sheet material for box making and joining end portions together; and a counter ejector unit that stacks the box bodies while counting the box bodies, and then discharges the box bodies every predetermined number, in which the printing section includes the printing device.

Accordingly, in the printing section, the sheet is pressed against the sheet transfer surface by the drive bodies, and therefore, printing by the inkjet head is performed in a state where the distance between the sheet and the inkjet head is kept constant. As a result, the inkjet head is stably supported regardless of the shape of the sheet, and thus the distance between the sheet and the inkjet head is kept constant and the sheet is appropriately transferred, whereby it is possible to suppress a decrease in printing accuracy.

Advantageous Effects of Invention

According to the printing unit, the printing device, and the box making machine of the present invention, the inkjet head is stably supported regardless of the shape of the sheet, and thus the distance between the sheet and the inkjet head is kept constant and the sheet is appropriately transferred, whereby it is possible to suppress a decrease in printing accuracy.

DESCRIPTION OF EMBODIMENTS

Hereinafter, a preferred embodiment of a printing unit, a printing device, and a box making machine according to the present invention will be described in detail with reference to the accompanying drawings. The present invention is not limited to this embodiment, and in a case where there are a plurality of embodiments, the present invention also includes configurations made by combining the respective embodiments.

Figure 1:
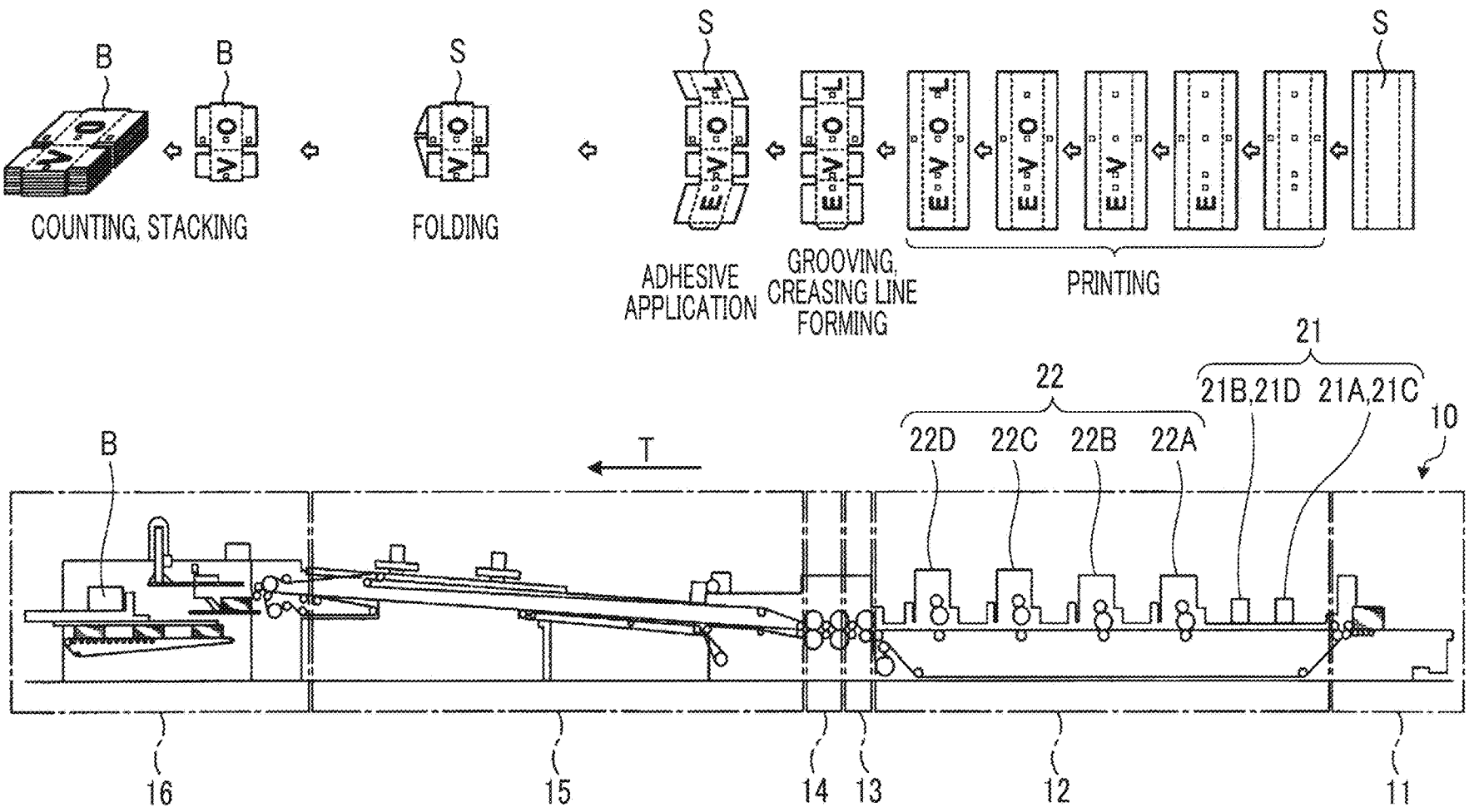
FIG. 1 is a schematic diagram showing a box making machine of the present embodiment.

FIG. 1 is a schematic diagram showing a box making machine of the present embodiment.

In this embodiment, as shown in FIG. 1, a box making machine 10 is for manufacturing a cardboard box B by processing a cardboard sheet S. The box making machine 10 includes a sheet feeding unit 11, a printing section 12, a slotter creaser unit 13, a die cutting unit 14, a folding unit 15, and a counter ejector unit 16 which are disposed in a straight line along a transfer direction T transferring the cardboard sheet S and the cardboard box B.

The sheet feeding unit 11 is for holding a large number of plate-shaped cardboard sheets S stacked in the vertical direction, and feeding the cardboard sheets S one by one to send the cardboard sheet S to the printing section 12 at a constant speed. The printing section 12 includes a first printing section 21 and a second printing section 22. The first printing section 21 includes four inkjet type printing units 21A, 21B, 21C, and 21D, and the second printing section 22 includes four flexographic printing units 22A, 22B, 22C, and 22D.

The first printing section 21 can perform single-color printing or multicolor printing. In the first printing section 21, two inkjet type printing units 21A and 21C are disposed along the width direction of the cardboard sheet S, and two inkjet type printing units 21B and 21D are disposed along the width direction of the cardboard sheet S. Further, the two inkjet type printing units 21A and 21C and the two inkjet type printing units 21B and 21D are disposed at a predetermined interval along the transfer direction T. The second printing section 22 can perform multicolor printing (four-color printing in this embodiment) on the cardboard sheet S. In the second printing section 22, the four flexographic printing units 22A, 22B, 22C, and 22D are disposed at predetermined intervals along the transfer direction T. In this embodiment, the first printing section 21 prints a bar code or the like on the printing surface of the cardboard sheet S, and the second printing section 22 prints a pattern such as characters on the printing surface of the cardboard sheet S.

The slotter creaser unit 13 is for performing creasing line processing and grooving processing on the cardboard sheet S. The die cutting unit 14 is for performing hand hole punching on the cardboard sheet S. The folding unit 15 is for folding the cardboard sheet S while moving it in the transfer direction T, and joining both end portions in the width direction to form the flat cardboard box B. The counter ejector unit 16 is for stacks the cardboard boxes B manufactured by the folding unit 15 while counting them, and then sorting them into a predetermined number of batches to discharge them.

Figure 2:
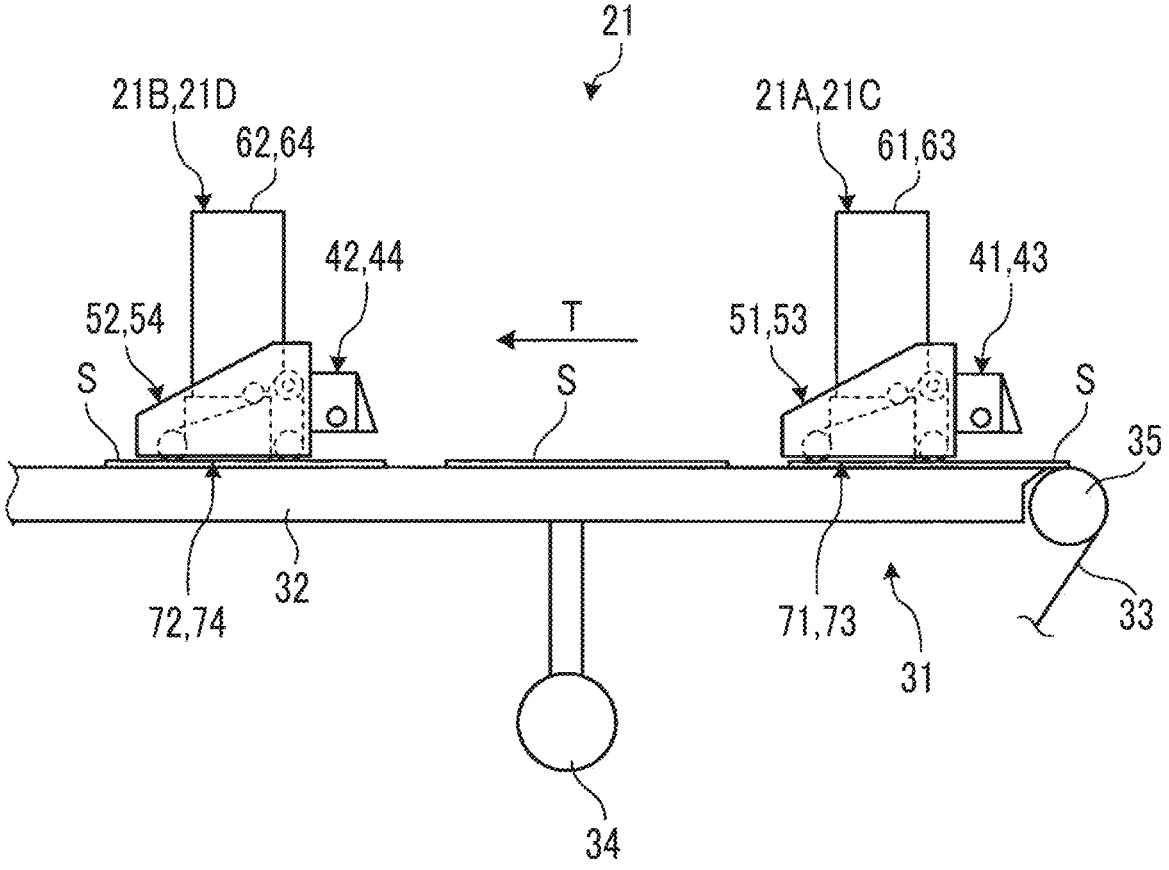
FIG. 2 is a side view showing a first printing section of the present embodiment.
Figure 3:
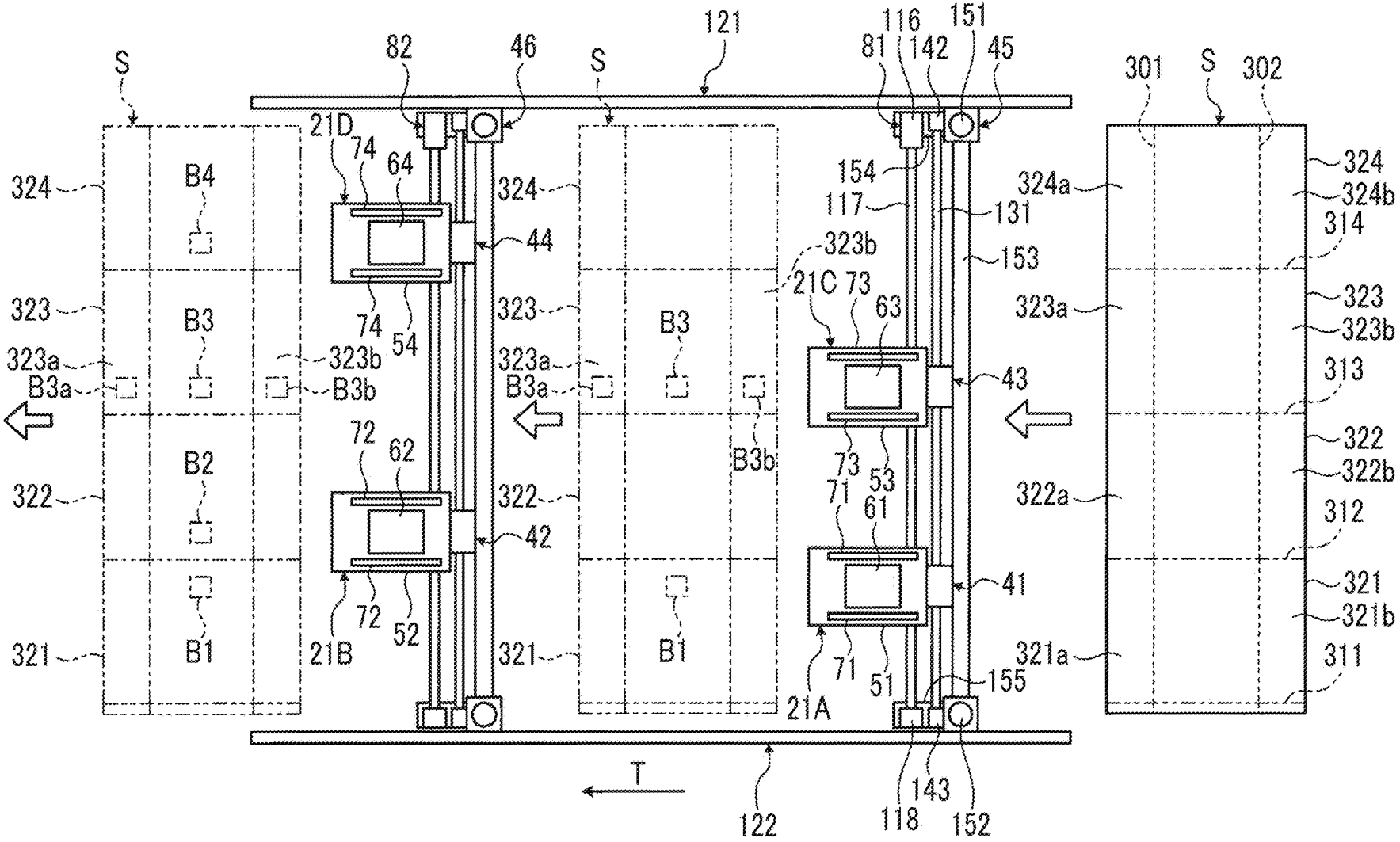
FIG. 3 is a plan view showing the first printing section of the present embodiment.

FIG. 2 is a side view showing the first printing section of this embodiment, and FIG. 3 is a plan view showing the first printing section of this embodiment.

In this embodiment, as shown in FIGS. 2 and 3, the first printing section 21 is for printing a bar code on the printing surface (front surface) of the cardboard sheet S, and includes the four inkjet type printing units (hereinafter, printing units) 21A, 21B, 21C, and 21D.

The first printing section 21 is disposed above a transfer conveyor unit 31 to face the transfer conveyor unit 31. The transfer conveyor unit 31 is for continuously transferring the cardboard sheets S supplied from the sheet feeding unit 11 (refer to FIG. 1) at a predetermined interval along the transfer direction T. The transfer conveyor unit 31 transfers the cardboard sheet S while suctioning the non-printing surface (lower surface) of the cardboard sheet S. The transfer conveyor unit 31 includes a suction section 32 and a transfer belt 33.

The suction section 32 is disposed along the transfer direction T of the cardboard sheet S and has a width larger than the width of the cardboard sheet S which is transferred. Although not shown, the suction section 32 is a closed hollow box-shaped suction box and has a configuration in which a large number of suction holes are formed in an upper surface portion of the suction box. A suction blower 34 is connected to the suction section 32. Therefore, the suction blower 34 is driven, whereby air in the suction box of the suction section 32 can be sucked to generate a suction force in each suction hole.

The transfer belt 33 is an endless belt and is supported by being wound around a drive roller 35 and a plurality of guide rollers (not shown). The transfer belt 33 is disposed so as to come into contact with the upper surface portion of the suction box of the suction section 32, and a large number of through-holes (not shown) are formed therein. Therefore, when a suction force acts on the suction box of the suction section 32, the suction force acts on the upper surface of the transfer belt 33 from each suction hole of the suction box through each through-hole of the transfer belt 33. Then, the cardboard sheet S is transferred while being sucked to the upper surface of the transfer belt 33 which is moved by the drive roller 35.

The first printing section 21 includes the four printing units 21A, 21B, 21C, and 21D. A plurality of first printing sections 21 are disposed at predetermined intervals in the transfer direction T of the cardboard sheet S, and the plurality of first printing sections 21 are disposed in the width direction of the cardboard sheet S. That is, the first printing unit 21A and the third printing unit 21C are disposed side by side in the width direction of the cardboard sheet S, and the second printing unit 21B and the fourth printing unit 21D are disposed side by side in the width direction of the cardboard sheet S. Then, the first printing unit 21A and the third printing unit 21C, and the second printing unit 21B and the fourth printing unit 21D are disposed at a predetermined interval in the transfer direction T of the cardboard sheet S.

As shown in FIGS. 1 and 3, the cardboard sheet S is formed by gluing a corrugated medium between a bottom liner and a top liner. In a preceding step of the box making machine 10, two folding lines 301 and 302 are formed in the cardboard sheet S. The folding lines 301 and 302 are for folding flaps when the manufactured cardboard box B is assembled later. Then, in the slotter creaser unit 13, creasing lines 311, 312, 313, and 314 are formed in the cardboard sheet S. Thereafter, in the cardboard sheet S, grooves are formed at the positions of the creasing lines 312, 313, and 314, and an end portion is cut at the position of the creasing line 311 to form a gluing margin strip. Therefore, the cardboard sheet S includes four sheet pieces 321, 322, 323, and 324 with the creasing lines 312, 313, and 314 (grooves) as boundaries. The sheet pieces 321, 322, 323, and 324 respectively have a pair of flaps 321*a* and 321*b*, a pair of flaps 322*a* and 322*b*, a pair of flaps 323*a* and 323*b*, and a pair of flaps 324*a* and 324*b*.

The first printing unit 21A performs printing on the sheet piece 321 or the flaps 321*a* and 321*b* thereof, the second printing unit 21B performs printing on the sheet piece 322 or the flaps 322*a* and 322*b* thereof, the third printing unit 21C performs printing on the sheet piece 323 or the flaps 323*a* and 323*b* thereof, and the fourth printing unit 21D performs printing on the sheet piece 324 or the flaps 324*a* and 324*b* thereof. For example, when the cardboard sheet S is transferred along the transfer direction T, first, the first printing unit 21A prints a bar code B1 on the sheet piece 321, and at the same time, the third printing unit 21C prints bar codes B3, B3*a*, and B3*b* on the sheet piece 323 and the flaps 323*a* and 323*b*. When the cardboard sheet S is further transferred along the transfer direction T, next, the second printing unit 21B prints a bar code B2 on the sheet piece 322, and at the same time, the fourth printing unit 21D prints a bar code B4 on the sheet piece 324.

The first printing unit 21A and the third printing unit 21C can be moved in the width direction of the cardboard sheet S by first movement adjusting devices 41 and 43, respectively, and thus the printing positions thereof in the width direction of the cardboard sheet S can be adjusted. The second printing unit 21B and the fourth printing unit 21D can be moved in the width direction of the cardboard sheet S by first movement adjusting devices 42 and 44, respectively, and thus the printing positions thereof in the width direction of the cardboard sheet S can be adjusted. Further, the first printing unit 21A and the third printing unit 21C can be moved in the vertical direction orthogonal to the printing surface of the cardboard sheet S by a second movement adjusting device 45, and thus the printing distances thereof with respect to the printing surface of the cardboard sheet S can be adjusted. The second printing unit 21B and the fourth printing unit 21D can be moved in the vertical direction orthogonal to the printing surface of the cardboard sheet S by a second movement adjusting device 46, and thus the printing distances thereof with respect to the printing surface of the cardboard sheet S can be adjusted.

The printing units 21A, 21B, 21C, and 21D have substantially the same configuration and include support frames 51, 52, 53, and 54, inkjet heads 61, 62, 63, and 64, and drive bodies 71, 72, 73, and 74, and drive devices 81 and 82. That is, in the printing units 21A, 21B, 21C, and 21D, the inkjet heads 61, 62, 63, and 64 and the drive bodies 71, 72, 73, and 74 are mounted on the support frames 51, 52, 53, and 54, the drive bodies 71 and 73 can be synchronously driven and rotated by the drive device 81, and the drive bodies 72 and 74 can be synchronously driven and rotated by the drive device 82.

Figure 4:
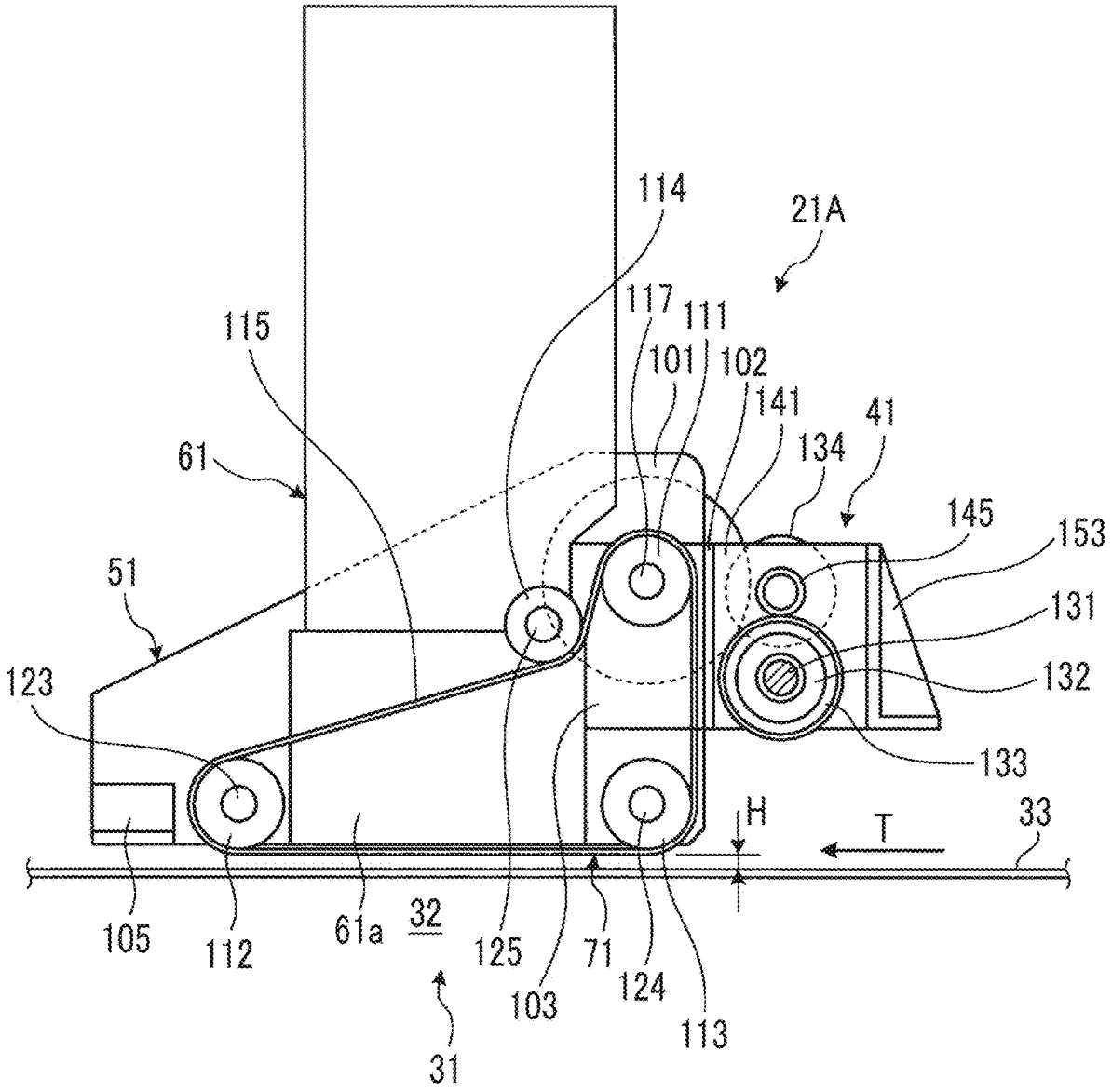
FIG. 4 is a side view showing a printing unit.
Figure 5:
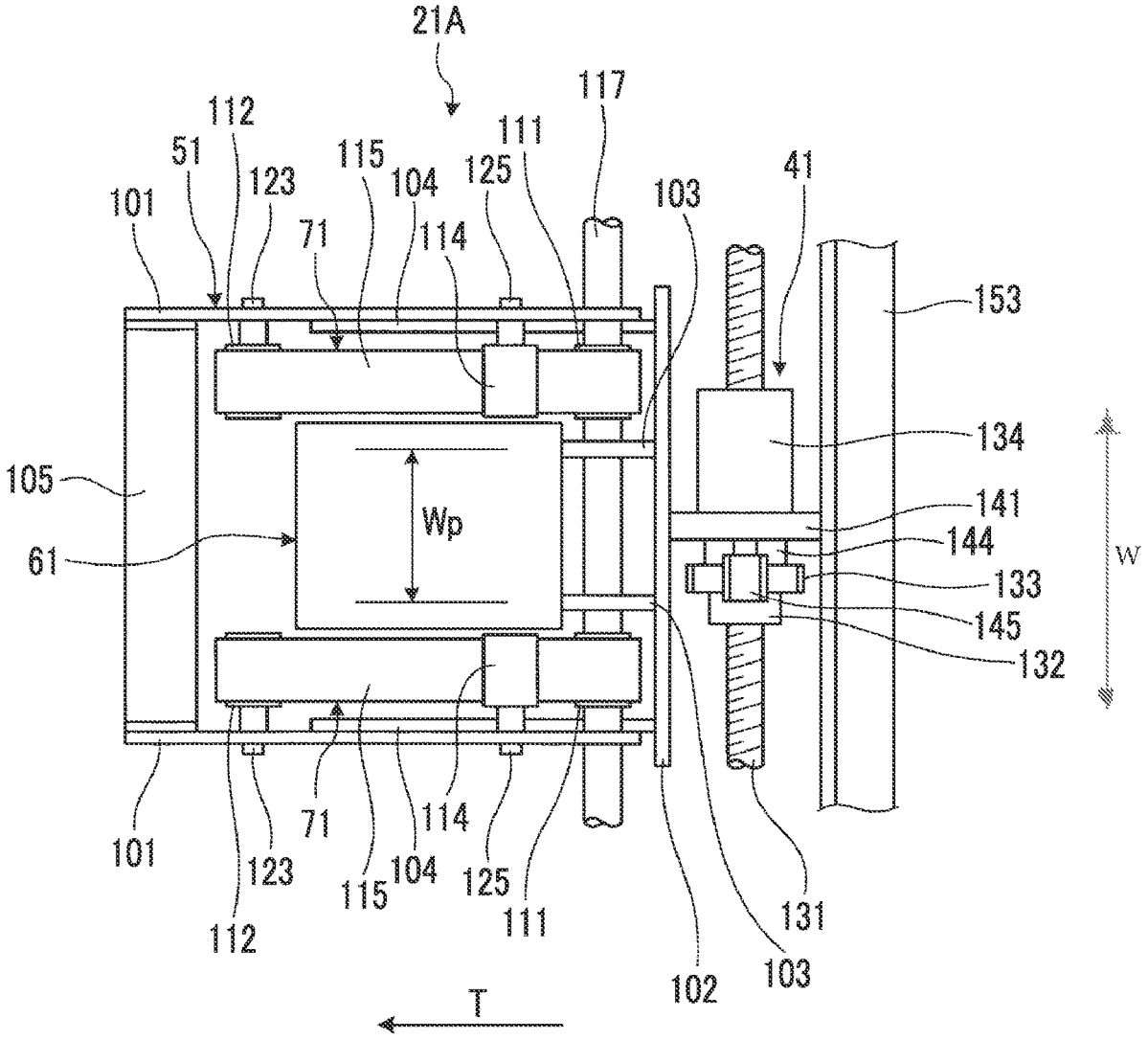
FIG. 5 is a plan view showing the printing unit.

Hereinafter, the printing units 21A, 21B, 21C, and 21D will be described. However, since the printing units 21A, 21B, 21C, and 21D have substantially the same configuration, only the first printing unit 21A will be described. FIG. 4 is a side view showing the printing unit, and FIG. 5 is a plan view showing the printing unit. In FIG. 4, a side frame on the front side is omitted.

As shown in FIGS. 4 and 5, in the first printing unit 21A, the support frame 51 is supported to face the transfer passage for the cardboard sheet S, that is, the upper surface of the transfer belt 33. The support frame 51 has a pair of left and right side frames 101, a connection frame 102 that connects the pair of left and right side frames 101, and a pair of mounting frames 103 that is disposed between the pair of left and right side frames 101 and connected to the connection frame 102. Each of the side frames 101 has a substantially triangular shape in which the front side thereof in the transfer direction T of the cardboard sheet S has an acute angle, and extends along the transfer direction T of the cardboard sheet S and the vertical direction, and the side frames 101 are disposed at a predetermined interval in the width direction of the cardboard sheet S.

The connection frame 102 has a rectangular shape and is disposed along the width direction of the cardboard sheet S and the vertical direction. The connection frame 102 connects the end portions of the pair of left and right side frames 101 on the rear side in the transfer direction T of the cardboard sheet S through connection pieces 104. The side frame 101 and the connection frame 102 are connected orthogonally to each other. Each of the pair of mounting frames 103 has a rectangular shape and extends along the transfer direction T of the cardboard sheet S and the vertical direction, and the mounting frames 103 are disposed at a predetermined interval in the width direction of the cardboard sheet S. The pair of mounting frames 103 is connected to the connection frame 102 at the end portions thereof on the rear side in the transfer direction T of the cardboard sheet S, and supports the inkjet head 61 at the end portions thereof on the front side in the transfer direction T of the cardboard sheet S. Further, the end portions of the pair of left and right side frames 101 on the front side in the transfer direction T of the cardboard sheet S are connected by a reinforcing frame 105.

The inkjet head 61 is disposed in a space portion surrounded by the pair of left and right side frames 101, the connection frame 102, and the reinforcing frame 105, and is supported on the connection frame 102 by the pair of mounting frames 103. The inkjet head 61 has a head main body 61*a* at a lower portion thereof, and the head main body 61*a* can perform printing on a predetermined print width area Wp in the width direction of the cardboard sheet S on the printing surface of the cardboard sheet S. The inkjet head 61 extrudes ink from a nozzle of the head main body 61*a* to make the extruded ink reach the printing surface of the cardboard sheet S as minute droplets, and for example, a continuous type, an on-demand type (piezo type or thermal type), or the like can be used.

The drive bodies 71 are disposed on both sides of the inkjet head 61 in the width direction of the cardboard sheet S, and are rotatably supported on the support frame 51, so that they can come into contact with the printing surface of the cardboard sheet S. Each of the drive bodies 71 includes a drive roller 111, driven rollers 112 and 113, an idler 114, and a drive belt 115. As shown in FIG. 3, the drive device 81 includes a drive motor 116, a drive shaft 117, and a bearing 118, and drives and rotates the drive bodies 71.

A pair of left and right printing machine frames 121 and 122 are disposed on both sides in the transfer direction T of the cardboard sheet S. The drive motor 116 is disposed on one printing machine frame 121 side, and the bearing 118 is disposed on the other printing machine frame 122 side. The drive shaft 117 is disposed along the width direction of the cardboard sheet S, one end portion thereof in the axial direction is drivingly connected to the drive motor 116, and the other end portion in the axial direction is rotatably supported on the bearing 118.

As shown in FIGS. 4 and 5, the drive shaft 117 horizontally penetrates the rear-side upper portions of the side frame 101 and the mounting frame 103, and each of the pair of left and right drive rollers 111 is fixed between each of the left and right side frames 101 and the inkjet head 61. The driven rollers 112 and 113 are rotatably supported on the front and rear lower portions of each of the left and right side frames 101 by supporting shafts 123 and 124 between each of the left and right side frames 101 and the inkjet head 61. The idler 114 is rotatably supported on an upper portion of each of the left and right side frames 101 by a supporting shaft 125 between each of the left and right side frames 101 and the inkjet head 61. The drive belt 115 is an endless belt, is wound around the outsides of the drive roller 111 and the driven rollers 112 and 113, and is pressed from the outside by the idler 114.

Therefore, as shown in FIGS. 3 to 5, when the drive motor 116 is driven to drive and rotate the drive shaft 117 in the forward rotation direction, the drive roller 111 is driven and rotated together with the drive shaft 117, and the drive belt 115 wound around the drive roller 111 and the driven rollers 112 and 113 can be driven and rotated. In this case, the rotational speed (peripheral speed) of the drive belt 115 is the same as the moving speed (peripheral speed) of the transfer belt 33 that sucks and transfers the cardboard sheet S. However, the rotational speed (peripheral speed) of the drive belt 115 may be slightly higher than the moving speed of the transfer belt 33. Further, the portions of the drive belt 115 supported on the two driven rollers 112 and 113 protrude further downward than the support frame 51 in the vertical direction, that is, toward the transfer belt 33 side. A predetermined fixed gap H set in advance is secured between the upper surface of the transfer belt 33 that sucks and transfers the cardboard sheet S and the lower surface of the drive belt 115 that protrudes further downward than the support frame 51. The predetermined fixed gap H is set according to the thickness of the cardboard sheet S that is transferred, and is basically set to the thickness of the cardboard sheet S that is transferred, or an amount larger than the thickness of the cardboard sheet S.

However, the predetermined fixed gap H may be adjusted according to the rigidity of the cardboard sheet S. For example, when the rigidity of the cardboard sheet S is high, the predetermined fixed gap H is adjusted to be slightly smaller than the thickness of the cardboard sheet S (fixed gap H=thickness of the cardboard sheet S−adjustment amount H1), thereby performing a correction such that the cardboard sheet S, which is warped and has high rigidity, is pressed with a strong pressure by the drive belt 115. On the other hand, when the rigidity of the cardboard sheet S is low, the predetermined fixed gap H is adjusted to be slightly larger than the thickness of the cardboard sheet S (fixed gap H=thickness of the cardboard sheet S+adjustment amount H2), thereby performing a correction such that the cardboard sheet S, which is warped and has low rigidity, is pressed with a weak pressure by the drive belt 115. That is, with respect to the warped cardboard sheet S, the size of the predetermined fixed gap H, that is, the pressure which is suppressed by the drive belt 115 is adjusted according to the rigidity of the cardboard sheet S, whereby the cardboard sheet S can be transferred with the warp appropriately corrected and without being damaged.

The adjustment amount H2 of the predetermined fixed gap H is set as follows. When a target print position accuracy by the inkjet head is A [mm], the maximum value of the transfer speed of the cardboard sheet S is S [m/sec], and the flying speed of the ink droplet from the inkjet is D [m/sec], the adjustment amount H2 of the fixed gap H is calculated by the following expression.

$$H2=A\times(D\div S)$$

For example, when A is 0.127 mm (200 dpi), S is 7 m/sec, and D is 10 m/sec, H2 is 0.181 mm, and the fixed gap H can be increased by 0.181 mm at the maximum further than the thickness of the cardboard sheet S.

Here, when the transfer speed of the cardboard sheet S increases, the adjustment amount H2 decreases, and when the flying speed of the ink droplet increases, the adjustment amount H2 increases.

The first movement adjusting device 41 includes a screw shaft 131, a nut 132, a driven gear 133, and a drive motor 134. A mounting frame 141 that extends rearward in the transfer direction T of the cardboard sheet S from the connection frame 102 is fixed to the support frame 51. The screw shaft 131 is disposed along the width direction of the cardboard sheet S, one end portion thereof in the axial direction is fixed to a mounting member 142 disposed on the printing machine frame 121 side, and the other end portion in the axial direction is fixed to a mounting member 143 disposed on the printing machine frame 122 the side. The nut 132 is screwed to the screw shaft 131, and the driven gear 133 is fixed thereto, and the driven gear 133 is rotatably supported on the mounting frame 141 by a support member 144 so as not to be relatively movable in the axial direction. The drive motor 134 is fixed to the mounting frame 141, and a drive gear 145 meshes with the driven gear 133.

Therefore, when the drive motor 134 is driven to drive and rotate the drive gear 145, the driven gear 133 meshing with the drive gear 145 rotates, and the nut 132 integrated with the driven gear 133 rotates. When the nut 132 rotates, the nut 132 moves in the axial direction of the screw shaft 131 to which it is screwed, while rotating. Then, the mounting frame 141 to which the driven gear 133 integrated with the nut 132 is fixed, that is, the inkjet head 61 supported on the support frame 51 moves in the axial direction of the screw shaft 131. That is, the first movement adjusting device 41 moves the first printing unit 21A in the axial direction of the screw shaft 131, thereby moving the inkjet head 61 along the width direction of the cardboard sheet S, so that the print width area Wp of the inkjet head 61 can be adjusted in the width direction.

The second movement adjusting device 45 includes lifting devices 151 and 152, a lifting frame 153, and lifting support frames 154 and 155. The lifting frame 153 is disposed along the width direction of the cardboard sheet S, the lifting support frame 154 disposed on the printing machine frame 121 side is fixed to one end portion thereof in the longitudinal direction, and the lifting support frame 155 disposed on the printing machine frame 122 side is fixed to the other end portion in the axial direction. The lifting support frame 154 is equipped with the drive motor 116 and the mounting member 142, and the lifting support frame 155 is equipped with the bearing 118 and the mounting member 143. The lifting device 151 can move up and down with it supporting one end portion in the longitudinal direction of the lifting frame 153, and the lifting device 152 can move up and down with it supporting the other end portion in the longitudinal direction of the lifting frame 153. Then, the lifting frame 153 is fixed to the mounting frame 141.

Therefore, when the lifting devices 151 and 152 are driven to move the lifting frame 153 up and down, the first printing unit 21A and the first movement adjusting device 41 connected to the lifting frame 153 can be moved up and down. Then, the drive body 71 mounted on the first printing unit 21A moves up and down, whereby the position of the drive body 71 in the vertical direction is adjusted, and the amount of the fixed gap H between the upper surface of the transfer belt 33 and the lower surface of the drive belt 115 can be adjusted.

The printing units 21B, 21C, and 21D are not described, but have substantially the same configuration as the first printing unit 21A.

Figure 6:
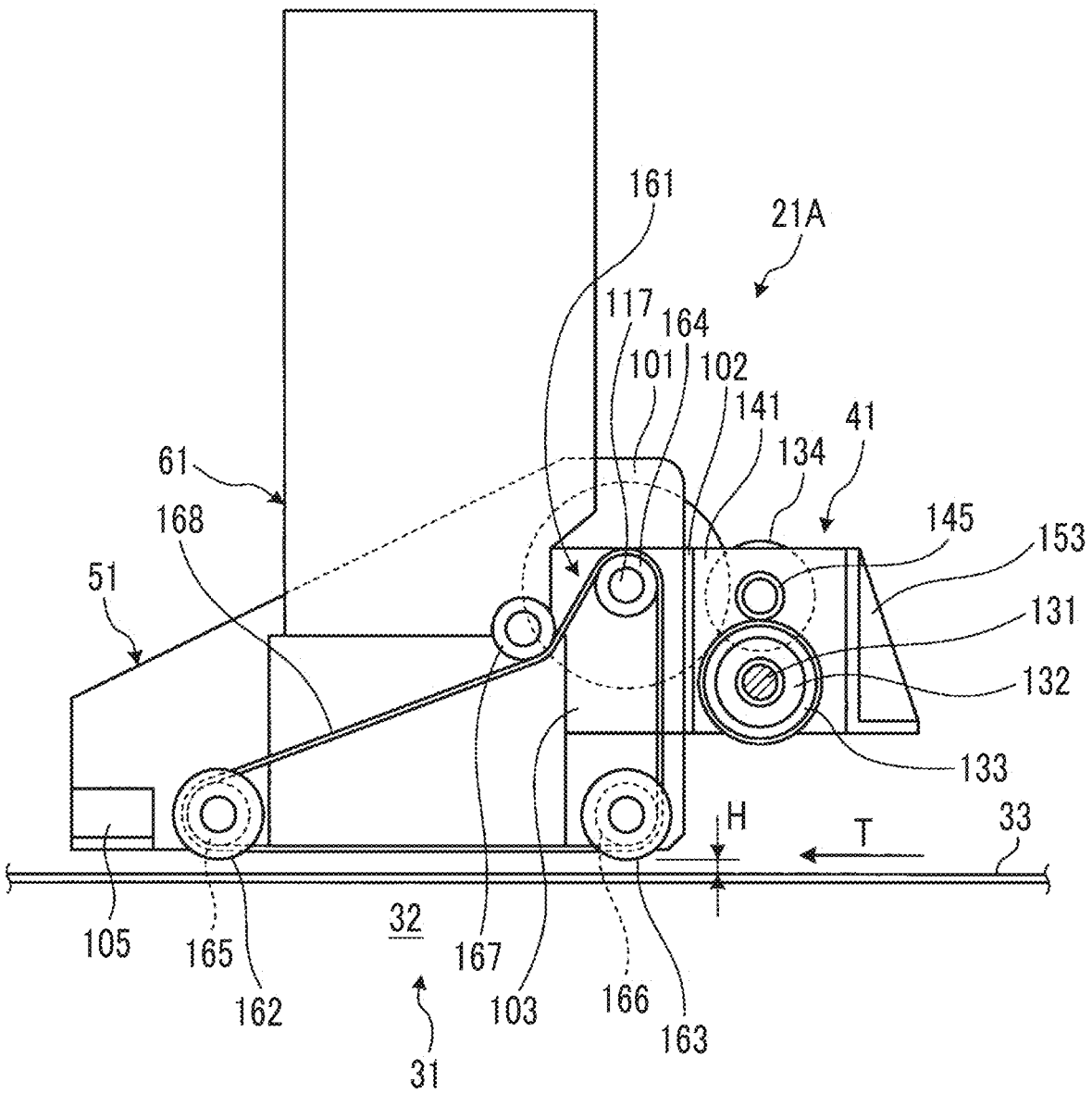
FIG. 6 is a side view showing a modification example of the printing unit of the present embodiment.

In the printing units 21A, 21B, 21C, and 21D of the first printing section 21, the drive body 71 is not limited to the drive body described above. FIG. 6 is a side view showing a modification example of the printing unit of this embodiment, and FIG. 7 is a plan view showing the modification example of the printing unit.

Figure 7:
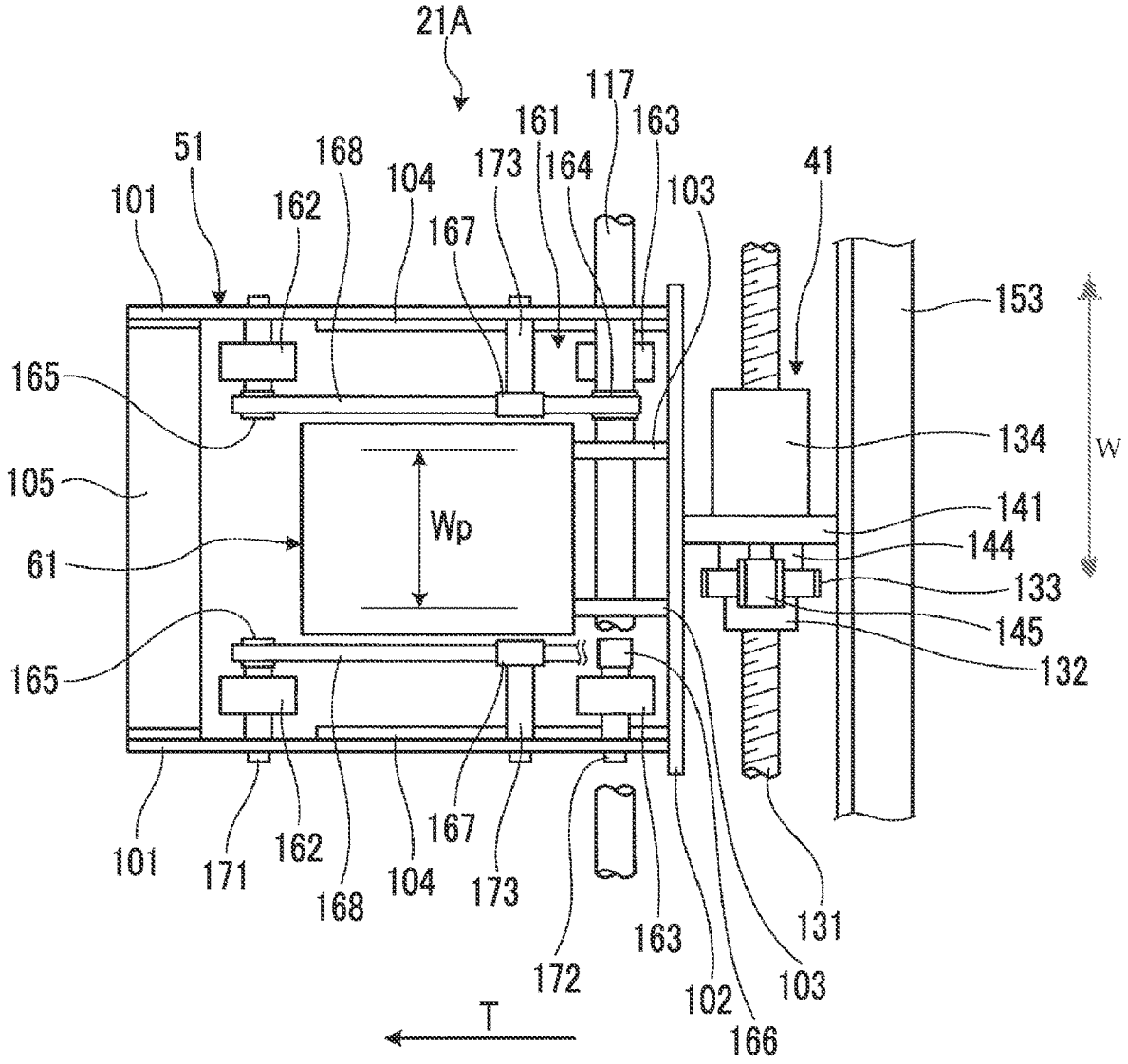
FIG. 7 is a plan view showing the modification example of the printing unit.

In the modification example of this embodiment, as shown in FIGS. 3, 6, and 7, the first printing unit 21A includes the support frame 51, the inkjet head 61, a drive body 161, and the drive device 81. That is, in the first printing unit 21A, the inkjet head 61 and the drive body 161 are mounted on the support frame 51, and the drive body 161 can be driven and rotated by the drive device 81.

The drive bodies 161 are disposed on both sides of the inkjet head 61 in the width direction of the cardboard sheet S, and are rotatably supported on the support frame 51, so that they can come into contact with the printing surface of the cardboard sheet S. Each of the drive bodies 161 includes drive rollers 162 and 163, a drive sprocket 164, driven sprockets 165 and 166, an idler 167, and a chain belt 168. The drive device 81 includes the drive motor 116, the drive shaft 117, and the bearing 118 and drives and rotates the drive bodies 161.

The drive shaft 117 horizontally penetrates the rear-side upper portions of the side frames 101 and the mounting frame 103, and each of the pair of left and right drive sprockets 164 is fixed between each of the left and right side frames 101 and the inkjet head 61. The pair of left and right drive rollers 162 and 163 are rotatably supported on the front and rear lower portions of each of the left and right side frames 101 by supporting shafts 171 and 172 between each of the left and right side frames 101 and the inkjet head 61. The pair of left and right driven sprockets 165 and 166 are respectively supported by the supporting shafts 171 and 172 so as to be rotatable integrally with the pair of left and right drive rollers 162 and 163. The idler 167 is rotatably supported on the upper portion of each of the left and right side frames 101 by a supporting shaft 173 between each of the left and right side frames 101 and the inkjet head 61. The chain belt 168 is an endless chain belt, which is wound around the outsides of the drive sprocket 164 and the driven sprockets 165 and 166 and is pressed from the outside by the idler 167.

Therefore, when the drive motor 116 is driven to drive and rotate the drive shaft 117 in the forward rotation direction, the drive sprocket 164 is driven and rotated together with the drive shaft 117, and thus the chain belt 168 wound around the drive sprocket 164 is driven, so that the driven sprockets 165 and 166 can be driven and rotated. Then, the drive rollers 162 and 163 integrated with the driven sprockets 165 and 166 can be driven. The two drive rollers 162 and 163 are disposed on the lower side than the support frame 51 in the vertical direction, that is, on the transfer belt 33 side. The fixed gap H is secured between the upper surface of the transfer belt 33 that sucks and transfers the cardboard sheet S and the lower portion of each of the drive rollers 162 and 163 that protrude further downward than the support frame 51. The fixed gap H has a size in which the drive rollers 162 and 163 can come into contact with the upper surface (printing surface) of the cardboard sheet S that is sucked to and transferred by the upper surface of the transfer belt 33.

In the embodiment described above, the number of driven rollers 112 and 113 is not limited to two, and may be one or three or more. Further, in the modification example of the embodiment described above, the number of drive rollers 162 and 163 is not limited to two, and may be one or three or more.

Hereinafter, the operation of the printing section 12 of this embodiment will be described.

As shown in FIG. 1, a large number of cardboard sheets S are stacked in the vertical direction on a sheet feeding table of the sheet feeding unit 11, and the cardboard sheet S which is located at the lowermost position is fed forward. Then, the cardboard sheet S is supplied toward the printing section 12 at a predetermined constant speed. As shown in FIGS. 2 and 3, in the printing section 12, the transfer conveyor unit 31 transfers the cardboard sheet S on the transfer belt 33 along the transfer direction T in a state where the suction section 32 suctions the cardboard sheet S on the transfer belt 33 from below. At this time, in the printing section 12, the first printing section 21 prints, for example, a bar code on the printing surface of the cardboard sheet S. Then, the second printing section 22 prints, for example, characters on the printing surface of the cardboard sheet S.

Then, the printed cardboard sheet S is transferred by the transfer conveyor unit 31, and as shown in FIG. 1, the slotter creaser unit 13 performs creasing line processing and grooving processing on the printed cardboard sheet S. Subsequently, the die cutting unit 14 performs hand hole punching on the cardboard sheet S, and the folding unit 15 folds the cardboard sheet S and joins both end portions in the width direction to form the flat cardboard box B. Thereafter, the counter ejector unit 16 stacks the manufactured cardboard boxes B while counting them, and then sorts them into a predetermined number of batches and discharges them.

Here, the operation of the printing units 21A, 21B, 21C, and 21D of the first printing section 21 will be specifically described.

As shown in FIGS. 2 and 3, when the cardboard sheet S is transferred to the position where the first printing unit 21A and the third printing unit 21C are located, first, the first printing unit 21A prints the bar code B1 on the sheet piece 321, and at the same time, the third printing unit 21C prints the bar codes B3, B3*a*, and B3*b* on the sheet piece 323 and the flaps 323*a* and 323*b*. Then, when the cardboard sheet S is transferred to the position where the second printing unit 21B and the fourth printing unit 21D are located, next, the second printing unit 21B prints the bar code B2 on the sheet piece 322, and at the same time, the fourth printing unit 21D prints the bar code B4 on the sheet piece 324.

At this time, as shown in FIGS. 4 and 5, in the first printing unit 21A, the cardboard sheet S reaches the first printing unit 21A in a state where it is sucked to the upper surface of the transfer belt 33, and a leading end portion enters the fixed gap H between the upper surface of the transfer belt 33 and the lower surface of the drive belt 115 of the drive body 71. Then, the upper surface (printing surface) of the cardboard sheet S is pressed in contact with the drive belt 115 that is driven and rotated, while the lower surface of the cardboard sheet S is sucked to the upper surface of the transfer belt 33. At this time, the rotational speed (peripheral speed) of the drive belt 115 is the same as or slightly higher than the moving speed (peripheral speed) of the transfer belt 33, and therefore, the cardboard sheet S is stably transferred in a state where it is sandwiched between the transfer belt 33 and the drive belt 115.

Therefore, for example, even if the leading end portion of the cardboard sheet S in the transfer direction T is warped toward the upper side, the warped leading end portion of the cardboard sheet S is pressed by the drive belt 115 that is driven and rotated, so that the cardboard sheet S is corrected into a flat shape or a shape close to a flat shape. Even if the cardboard sheet S is warped toward the lower side, the cardboard sheet S is pressed by the drive belt 115 that is driven and rotated, to be corrected into a flat shape or a shape close to a flat shape. Then, the drive belt 115 comes into contact with the printing surface of the cardboard sheet S at a portion having a predetermined length in the transfer direction T and moves along the transfer direction T, and therefore, the cardboard sheet S is stably transferred in a flat shape without buckling. Then, the distance between the printing surface of the cardboard sheet S and the inkjet head 61 is maintained at a constant distance, and thus the inkjet head 61 can perform highly accurate printing on the printing surface of the cardboard sheet S.

In this manner, the printing unit of this embodiment includes the support frames 51, 52, 53, and 54 that are supported to face the transfer passage for the cardboard sheet S, the inkjet heads 61, 62, 63, and 64 that are fixed to the support frames 51, 52, 53, and 54 and perform printing on the printing surface of the cardboard sheet S, the drive bodies 71, 72, 73, and 74 (161) that are rotatably supported on the support frames 51, 52, 53, and 54 on both sides of the inkjet heads 61, 62, 63, and 64 in the width direction of the cardboard sheet S and can come into contact with the printing surface of the cardboard sheet S, and the drive devices 81 and 82 that drives and rotates the drive bodies 71, 72, 73, and 74 (161).

Accordingly, when the cardboard sheet S is transferred, printing is performed on the printing surface of the cardboard sheet S by the inkjet heads 61, 62, 63, and 64. At this time, the drive bodies 71, 72, 73, and 74 (161) disposed on both sides of the inkjet heads 61, 62, 63, and come into contact with the printing surface of the cardboard sheet S on the transfer passage in a state of being driven and rotated by the drive devices 81 and 82. Then, even if the cardboard sheet S is warped toward the printing surface side, the cardboard sheet S is applied with a transfer force while being pressed against the transfer surface for the cardboard sheet S by the drive bodies 71, 72, 73, and 74 (161) that are driven and rotated. Therefore, since the cardboard sheet S is stably supported and transferred by the drive bodies 71, 72, 73, and 74 (161), printing by the inkjet heads 61, 62, 63, and 64 is performed in a state where the distance between the printing surface of the cardboard sheet S and the inkjet heads 61, 62, 63, and 64 is kept constant. As a result, the inkjet heads 61, 62, 63, and 64 are stably supported regardless of the shape of the cardboard sheet S, and thus the distance between the cardboard sheet S and the inkjet heads 61, 62, 63, and 64 is kept constant and the cardboard sheet S is appropriately transferred, whereby it is possible to suppress a decrease in printing accuracy.

In the printing unit of this embodiment, the predetermined fixed gap H which is set in advance according to the thickness of the cardboard sheet S is secured between the upper surface of the transfer belt 33 configuring the transfer passage for the cardboard sheet S and the drive bodies 71, 72, 73, and 74 (161). Accordingly, when the cardboard sheet S is transferred on the upper surface of the transfer belt 33, the cardboard sheet S enters the fixed gap H secured between the upper surface of the transfer belt 33 and the drive bodies 71, 72, 73, and 74 (161), whereby the drive bodies 71, 72, 73, and 74 (161) can press the printing surface of the cardboard sheet S and stably transfer the cardboard sheet S and printing by the inkjet heads 61, 62, 63, and 64 can be performed with the distance between the cardboard sheet S and the inkjet heads 61, 62, 63, and 64 being kept constant.

In the printing unit of this embodiment, the drive bodies 71, 72, 73, and 74 includes the drive rollers 111 which are disposed on both sides of the support frames 51, 52, 53, and 54 in the width direction of the cardboard sheet S and driven and rotated by the drive devices 81 and 82, the driven rollers 112 and 113 which are disposed in front and rear of the drive roller 111 in the transfer direction T of the cardboard sheet S on both sides of the support frames 51, 52, 53, and 54 in the width direction of the cardboard sheet S, and the drive belts 115 which are wound around the drive rollers 111 and the driven rollers 112 and 113 on both sides of the support frames 51, 52, 53, and 54 in the width direction of the cardboard sheet S. Accordingly, when the cardboard sheet S is transferred on the upper surface of the transfer belt 33, the printing surface of the cardboard sheet S is pressed continuously in the transfer direction T of the cardboard sheet S by the drive belts 115 that are wound around the drive rollers 111 and the driven rollers 112 and 113, and thus the cardboard sheet S can be stably transferred by the drive bodies 71, 72, 73, and 74.

In the printing unit of this embodiment, the drive body 161 includes the drive rollers 162 and 163 which are disposed on both sides of the support frames 51, 52, 53, and 54 in the width direction of the cardboard sheet S and driven and rotated by the drive devices 81 and 82. Accordingly, when the cardboard sheet S is transferred on the upper surface of the transfer belt 33, the printing surface of the cardboard sheet S is pressed by the drive rollers 162 and 163, and thus the cardboard sheet S can be stably transferred by the drive body 161 and a structure can be simplified.

The printing unit of this embodiment further includes the first movement adjusting devices 41, 42, 43, and 44 which adjust the positions of the inkjet heads 61, 62, 63, and 64 by moving the support frames 51, 52, 53, and 54 along the width direction of the cardboard sheet S. Accordingly, the inkjet heads 61, 62, 63, and 64 are moved along the width direction of the cardboard sheet S through the support frames 51, 52, 53, and 54 by the first movement adjusting devices 41, 42, 43, and 44 to adjust the positions of the inkjet heads 61, 62, 63, and 64, and therefore, the printing positions of the inkjet heads 61, 62, 63, and 64 in the width direction of the cardboard sheet S can be easily adjusted with high accuracy.

The printing unit of this embodiment further includes the second movement adjusting devices 45 and 46 which adjust the positions of the drive bodies 71, 72, 73, and 74 (161) by moving the support frames 51, 52, 53, and 54 in the direction orthogonal to the printing surface of the cardboard sheet S. Accordingly, the drive bodies 71, 72, 73, and 74 (161) are moved along the direction orthogonal to the printing surface through the support frames 51, 52, 53, and 54 by the second movement adjusting devices 45 and 46 to adjust the positions of the drive bodies 71, 72, 73, and 74, and therefore, the positions of the drive bodies 71, 72, 73, and 74 (161) can be easily adjusted with high accuracy according to the thickness of the cardboard sheet S.

Further, the printing device of this embodiment includes the plurality of printing units 21A, 21B, 21C, and 21D which are disposed at predetermined intervals in the transfer direction T of the cardboard sheet S. Accordingly, even if the printing positions of the plurality of printing units 21A, 21B, 21C, and 21D with respect to the printing surface of the cardboard sheet S are positions close to each other in the width direction of the cardboard sheet S, since the plurality of printing units 21A, 21B, 21C, and 21D are disposed in the transfer direction of the cardboard sheet S, the printing timings are deviated from each other without interference between the plurality of printing units 21A and 21C and the plurality of printing units 21B and 21D, and therefore, each of the printing units 21A, 21B, 21C, and 21D performs printing with high accuracy at a predetermined position.

Further, the printing device of this embodiment includes the first printing section 21 having the printing units 21A, 21B, 21C, and 21D, and the second printing section 22 having the flexographic printing units 22A, 22B, 22C, and 22D which are disposed downstream of the first printing section 21 in the transfer direction T of the cardboard sheet S. Accordingly, since the first printing section 21 performs printing on the printing surface of the cardboard sheet S and the second printing section 22 then performs printing on the printing surface of the cardboard sheet S, the time from the time when the first printing section 21 performs printing on the printing surface of the cardboard sheet S to the time when a member such as a belt comes into contact with the printing surface is lengthened, and thus the drying time of the ink in the first printing section 21 can be secured, and the print quality can be improved.

Further, the printing device of this embodiment includes the plurality of inkjet type printing units 21A, 21B, 21C, and 21D which are disposed in the width direction of the cardboard sheet S, in which the drive devices 81 and 82 synchronously drives and rotates the drive bodies 71, 72, 73, and 74 in the plurality of printing units 21A, 21B, 21C, and 21D. Accordingly, the drive devices 81 and 82 synchronously drive and rotate the respective drive bodies 71, 72, 73, and 74 in the plurality of printing units 21A, 21B, 21C, and 21D disposed in the width direction of the cardboard sheet S, and therefore, the respective drive bodies 71, 72, 73, and 74 can accurately and stably transfer the cardboard sheet S along the transfer passage.

Further, the box making machine of this embodiment includes the sheet feeding unit 11 that supplies the cardboard sheet S, the printing section 12 that performs printing on the cardboard sheet S, the slotter creaser unit that performs creasing line processing and grooving processing on the front surface of the cardboard sheet S, the folding unit 15 that forms the cardboard box B by folding the cardboard sheet S and joining end portions together, and the counter ejector unit 16 that stacks the cardboard boxes B while counting the cardboard boxes B, and then discharges the cardboard box B every predetermined number, in which the printing section 12 includes the inkjet type first printing section 21. Accordingly, the cardboard sheet S is transferred while being pressed against the transfer surface for the cardboard sheet S by the drive bodies 71, 72, 73, and 74. As a result, the inkjet heads 61, 62, 63, and 64 are stably supported regardless of the shape of the cardboard sheet S, and thus the distance between the cardboard sheet S and the inkjet heads 61, 62, 63, and 64 is kept constant and the cardboard sheet S is appropriately transferred, whereby it is possible to suppress a decrease in printing accuracy.

In the embodiment described above, the first printing section 21 is composed of four printing units 21A, 21B, 21C, and 21D, and the second printing section 22 is composed of four printing units 22A, 22B, 22C, and 22D. However, the number is not limited thereto and may be one or plural.

Further, in the embodiment described above, description has been made using the cardboard sheet S as a sheet. However, a sheet or the like which is used in a sheet-fed printing press may be used, and the printing unit according to the present invention can be applied to a printing unit that performs printing while continuously transferring a sheet having a predetermined size at a predetermined interval.

REFERENCE SIGNS LIST

10: box making machine
11: sheet feeding unit
12: printing section
13: slotter creaser unit
14: die cutting unit
15: folding unit
16: counter ejector unit (counter ejector)
21: first printing section (printing device)
21A, 21B, 21C, 21D: printing unit
22: second printing section
22A, 22B, 22C, 22D: printing unit
31: transfer conveyor unit
32: suction section
33: transfer belt
41, 42, 43, 44: first movement adjusting device
45, 46: second movement adjusting device
51, 52, 53, 54: support frame
61, 62, 63, 64: inkjet head
71, 72, 73, 74, 161: drive body
81, 82: drive device
111: drive roller
112, 113: driven roller
114: idler
115: drive belt
121, 122: printing machine frame
131: screw shaft
132: nut
133: driven gear
134: drive motor
141: mounting frame
145: drive gear
151, 152: lifting device
153: lifting frame
154, 155: lifting support frame
162, 163: drive roller
164: drive sprocket
165, 166: driven sprocket
167: idler
168: chain belt
H: fixed gap
S: cardboard sheet (sheet, sheet material for box making)
Wp: print width area

The invention claimed is:

1. A printing unit comprising:

a support frame that is supported to face a transfer passage for a sheet;

an inkjet head that is fixed to the support frame and performs printing on a printing surface of the sheet;

a drive body rotatably supported on the support frame on each side of the inkjet head in a width direction of the sheet and configured to come into contact with the printing surface of the sheet; and a drive device that drives and rotates the drive body, wherein the drive body includes rotating members which are disposed on each side of the inkjet head in the width direction of the sheet and driven and rotated by the drive device, and an adjustable gap which is set in advance according to a thickness of the sheet is formed between a sheet transfer surface defining the transfer passage for the sheet and the rotating members, and the rotating members guide the sheet so as to regulate floating of the sheet in a direction toward the inkjet head in the adjustable gap.

2. The printing unit according to claim 1, wherein the drive body includes drive belts as the rotating members which are disposed on each side of the support frame in the width direction of the sheet and driven and rotated by the drive device.

3. The printing unit according to claim 2, wherein the drive body further includes drive rollers which are disposed on each side of the support frame in the width direction of the sheet and driven and rotated by the drive device, and driven rollers which are disposed in front and rear of the drive roller in a transfer direction of the sheet on each side of the support frame in the width direction of the sheet.

4. The printing unit according to claim 1, wherein the drive body includes drive rollers as the rotating members which are disposed on each side of the support frame in the width direction of the sheet and driven and rotated by the drive device.

5. The printing unit according to claim 1, further comprising:

a first movement adjusting device which adjusts a position of the inkjet head by moving the support frame along the width direction of the sheet.

6. The printing unit according to claim 1, further comprising:

a second movement adjusting device which adjusts positions of the drive body by moving the support frame in a direction orthogonal to the printing surface of the sheet.

7. The printing unit according to claim 1, wherein the drive body includes drive rollers which are disposed on each side of the support frame in the width direction of the sheet and driven and rotated by the drive device, driven rollers which are disposed in front and rear of the drive roller in a transfer direction of the sheet on each side of the support frame in the width direction of the sheet, and drive belts which are wound around the drive rollers and the driven rollers on each side of the support frame in the width direction of the sheet.

8. The printing unit according to claim 7, further comprising:

a first movement adjusting device which adjusts a position of the inkjet head by moving the support frame along the width direction of the sheet.

9. The printing unit according to claim 7, further comprising:

a second movement adjusting device which adjusts positions of the drive bodies by moving the support frame in a direction orthogonal to the printing surface of the sheet.

10. The printing unit according to claim 1, wherein the drive body includes drive rollers which are disposed on each side of the support frame in the width direction of the sheet and driven and rotated by the drive device.

11. The printing unit according to claim 10, further comprising:

a first movement adjusting device which adjusts a position of the inkjet head by moving the support frame along the width direction of the sheet.

12. The printing unit according to claim 10, further comprising:

a second movement adjusting device which adjusts positions of the drive bodies by moving the support frame in a direction orthogonal to the printing surface of the sheet.

13. A printing device in which a plurality of printing units, each of the printing units being the printing unit according to claim 1, are disposed at predetermined intervals in a transfer direction of the sheet.

14. A box making machine comprising:

a sheet feeding unit that supplies a sheet material for box making;

a printing section that performs printing on the sheet material for box making;

a slotter creaser unit that performs creasing line processing and grooving processing on a front surface of the sheet material for box making;

a folding unit that forms a box body by folding the sheet material for box making and joining end portions together; and a counter ejector unit that stacks the box bodies while counting the box bodies, and then discharges the box bodies every predetermined number, wherein the printing section includes the printing device according to claim 13.

15. A printing device comprising:

the printing unit according to claim 1; and a flexographic printing unit that is disposed downstream of the printing unit in a transfer direction of the sheet.

16. A printing device in which a plurality of printing units, each of the printing units being the printing unit according to claim 1, are disposed in the width direction of the sheet, and the drive device synchronously drives and rotates the drive body in the plurality of printing units.

17. A box making machine comprising:

a sheet feeding unit that supplies a sheet material for box making;

a printing section that performs printing on the sheet material for box making;

a slotter creaser unit that performs creasing line processing and grooving processing on a front surface of the sheet material for box making;

a folding unit that forms a box body by folding the sheet material for box making and joining end portions together; and a counter ejector unit that stacks the box bodies while counting the box bodies, and then discharges the box bodies every predetermined number, wherein the printing section includes a printing device, the printing device including the printing unit according to claim 1 and a flexographic printing unit that is disposed downstream of the printing unit in a transfer direction of the sheet.

18. A box making machine comprising:

a sheet feeding unit that supplies a sheet material for box making;

a printing section that performs printing on the sheet material for box making;

a slotter creaser unit that performs creasing line processing and grooving processing on a front surface of the sheet material for box making;

a folding unit that forms a box body by folding the sheet material for box making and joining end portions together; and a counter ejector unit that stacks the box bodies while counting the box bodies, and then discharges the box bodies every predetermined number, wherein the printing section includes a printing device in which a plurality of printing units are disposed in a width direction of the sheet, and the drive device synchronously drives and rotates the drive bodies in the plurality of printing units, each of the printing units being the printing unit according to claim 1.

* * * * *